United States Patent [19]

Helfi et al.

[11] 4,416,443

[45] Nov. 22, 1983

[54] PROCESS AND APPARATUS FOR DETECTION OF THE STOPPAGE OF A TUYERE FOR BLOWING A GAS THROUGH THE BOTTOM OF A REFINING CONVERTER

[75] Inventors: Alfred F. Helfi, Thionville; Jean-Claude H. Muller, Longeville-les-Metz, both of France

[73] Assignee: Societe Lorraine de Laminage Continu, Paris, France

[21] Appl. No.: 398,361

[22] Filed: Jul. 14, 1982

[30] Foreign Application Priority Data

Dec. 8, 1981 [FR] France ..... 81 22936

[51] Int. Cl.[3] ..... C21B 7/16

[52] U.S. Cl. ..... 266/47; 75/60

[58] Field of Search ..... 266/47, 99, 87; 75/59, 75/60

[56] References Cited

U.S. PATENT DOCUMENTS

| | | | |
|---|---|---|---|
| 3,830,480 | 8/1974 | Grant | 266/99 |
| 4,106,756 | 8/1978 | Rymarchyk | 266/99 |

FOREIGN PATENT DOCUMENTS

| | | | |
|---|---|---|---|
| 1783149 | 8/1972 | Fed. Rep. of Germany | 75/60 |
| 7824154 | 3/1979 | France | 75/60 |

*Primary Examiner*—Peter D. Rosenberg

*Attorney, Agent, or Firm*—Posnack, Roberts, Cohen & Spiecens

[57] ABSTRACT

One detects the stoppage of a tuyere 1 for blowing in, under the surface of the metallic bath 2 of a converter, of a compressed gas delivered regularly at a lower pressure than the compression pressure by measuring, by a sensor 17, the temperature of the tuyere 1 in the region 16 of the upstream end 15 of the tuyere in the vicinity of the base plate 11 of the converter and one detects an abnormal elevation of the temperature indicating a stoppage of the tuyere (1).

11 Claims, 4 Drawing Figures

PROCESS AND APPARATUS FOR DETECTION OF THE STOPPAGE OF A TUYERE FOR BLOWING A GAS THROUGH THE BOTTOM OF A REFINING CONVERTER

Field of the Invention

The present invention relates to a process and apparatus for the detection of the stoppage of a tuyere for a compressed gas delivered regularly at a pressure lower than the compression pressure. More particularly, the invention relates to the detection of the stoppage of tuyeres in the refining of pig iron by a process of blowing oxygen, nitrogen or argon under the surface of the metal bath.

PRIOR ART

During this operation, industrially pure oxygen, nitrogen, or argon is blown in under pressure, by means of one or more tuyeres 1 (FIGS. 1,2) located below the surface of the metallic bath 2, for example through the bottom of a converter. In the case of blowing in pure oxygen, these tuyeres are composed of two coaxial tubes, the conduit 3 of the central tube 4 being utilized for the passage of oxygen and powdered lime, the conduit 5 of the peripheral tube 6 serving for the passage of an endothermic decomposition fluid, for example, a liquid or gaseous hydrocarbon, or liquid $CO_2$ destined for the protection of the tuyeres and of refractory material 7 against the action of the pure oxygen.

In the case of blowing in of nitrogen or argon, the tuyeres which only comprise a single tube 4 are not protected by the blowing in of an endothermic decomposition fluid.

Different factors can cause the stoppage of a tuyere.

Thus, as shown in FIG. 1, it sometimes happens at the time of supply of scrap iron into the converter that the scrap iron falls against the downstream extremity or nozzle 8 of a tuyere, totally or partially closing the conduits 3 and 5; this happens more especially as the nozzles 8 of the tuyeres are sometimes surrounded by a small crater 9.

Another factor in the stoppage of the central conduit 3 shown in FIG. 2, is its clogging by the lime powder (deposits 10) during the refining operation.

It goes without saying that the two factors for stoppage can also be combined.

This stoppage phenomenon, when limited to a few oxygen blowing tuyeres, has little effect on the metallurgical process. But at the time of stoppage of a tuyere, as the central tube 4 is no longer traversed by the flow of oxygen, which ordinarily protects it against all liquid or solid intrusions, gaseous or liquid hydrocarbons and liquid metal can flow into the interior of this tube and, upon contact with the gaseous oxygen upstream of the stoppage, can cause destruction by live combustion of the tuyeres concerned and of all or a portion of the upstream part of the oxygen feed circuit.

When the stoppage is related to tuyeres for the blowing in of nitrogen or argon, it has in addition an unfavorable effect on the metallurgical process.

SUMMARY OF THE INVENTION

An object of the invention is to provide a process for rapid and simple detection of the stoppage of the tuyeres for blowing in pure oxygen or nitrogen or argon enabling one to take the necessary measures in proper time.

This object is achieved, according to the invention, by the fact that one measures the temperature of the tuyeres in the region of the upstream extremity of the tuyeres in the vicinity of the base plate of the converter and one detects any abnormal increase of temperature indicating a stoppage of the tuyeres.

The process of the invention has its scientific justification in the following considerations:

The blowing in of oxygen, argon or nitrogen is effected at a nominal pressure of 16 bars, the pressure of blowing in of the oxygen, argon or nitrogen diminishing proportionally as the gas approaches the nozzle 8 of the tuyere. The expansion of the compressed oxygen, argon or nitrogen absorbs heat. In the tuyeres which are located at the bottom of the converter, this phenomenon is produced with an intensity proportional to the volume of the expanded gas.

In the case of a tuyere stoppage, for example for one of the two reasons enumerated previously, the expansion of the gas does not take place and there is no absorption of heat or cooling of the tuyere which leads, with a continuous measurement of the temperature, to an abnormal elevation of this temperature.

The invention also relates to an apparatus for carrying out the process of the invention. This apparatus comprises a temperature sensor situated in the region of the upstream extremity of the tuyere in the vicinity of the base plate of the converter and a means for detection of abnormal elevation of the temperature indicating a stoppage of a tuyere.

The detection means can comprise an instantaneous visual indicator of the temperature and/or a system for recording the temperature, notably a graphic recorder. It can also comprise an associated electronic device for converting the elevation of temperature, above a given threshold value, to a sound signal, a visual signal or a signal for automatically leading to take the measures required to correct the stoppage of the tuyere.

The cooling of each tuyere due to the expansion is preferably sensed by means of a thermocouple having a low thermal inertia.

Naturally, the process and the apparatus of the invention can also be applied to the injection of nitrogen or argon in the conversion processes utilizing these gases.

In a general manner, they are applicable to the surveillance of tuyeres delivering a gas under a pressure substantially lower than the compression pressure.

DETAILED DESCRIPTION

Figure 1:
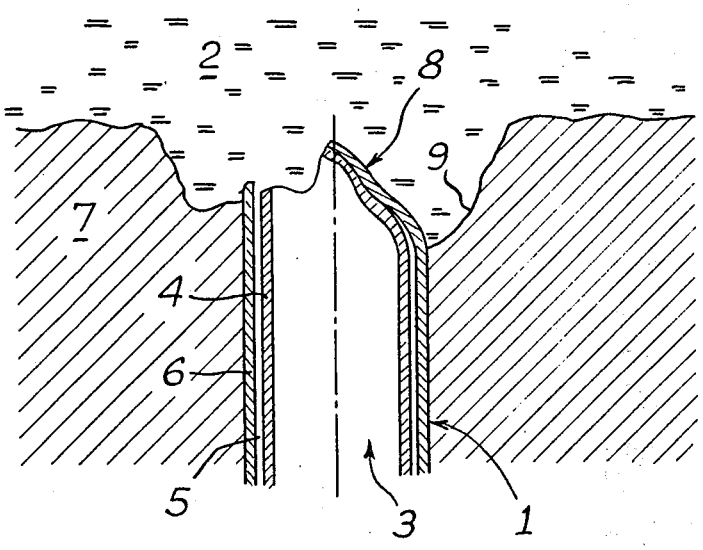
FIGS. 1 and 2, show in section the outlet end of a tuyere in the bottom of a converter with indication of two factors of stoppage.
Figure 2:
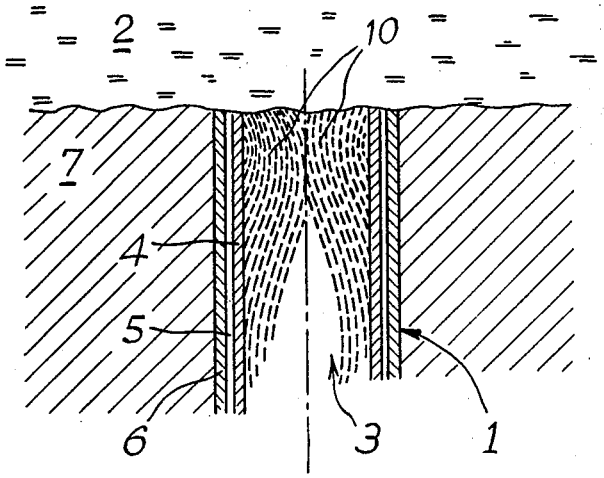
Figure 3:
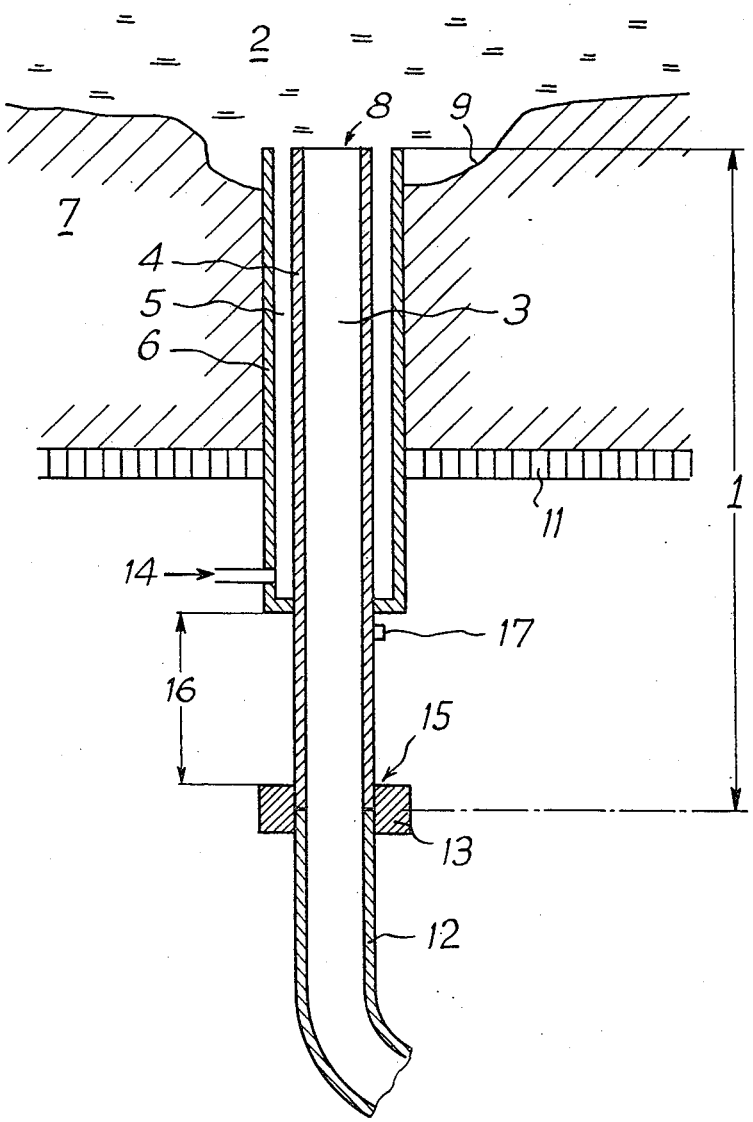
FIG. 3 shows the feed of a tuyere, situated in the bottom of a converter, equipped with the apparatus of the invention.

As shown in FIG. 3, a tuyere 1 for blowing in of pure oxygen and of a gaseous or liquid hydrocarbon or liquid $CO_2$ comprises two coaxial tubes 4 and 6. The tuyere 1 extends through the base plate 11 of the converter and refractory lining material 7 to open under liquid bath 2.

The conduit 3 of the central tube 4 is fed with liquid oxygen and powdered lime by a feed conduit 12 connected to the central tube 4 by a connection apparatus 13. This peripheral conduit 5 is fed at 14 by liquid or gaseous hydrocarbon or by liquid $CO_2$.

In the preferred application of the invention, in order to detect an abnormal elevation of the temperature of the tuyere, its temperature is measured at the conduit 4, for the injection of oxygen, nitrogen or argon, under the base plate 11 in proximity to the upstream end 15 of the tuyere 1 in the zone designated by 16 in FIG. 3. This zone is selected for reasons of accessibility to the tube 4. One could also measure the temperature of the feed conduit 12, preferably in the region of its connection 13 with the tuyere 1. A sensor for measurement of temperature 17 placed as close as possible under the base plate, on the tube 4 of each tuyere, at the side of the upstream extremity of the tuyere, measures the temperature of each tuyere 1. The measurement sensor is preferably a thermocouple having a low thermal inertia. The temperature measured by each thermocouple for each tuyere can be indicated in instantaneous visual manner, in continuous manner, or recorded graphically. The measured temperatures are preferably transmitted to an associated electronic instrument converting the abnormal increase of temperature of a stopped tube, above a given temperature threshold value, to a sound signal with visual indication of the stopped tube by illumination of a conspicuous indicator associated with the concerned tuyere.

Figure 4:
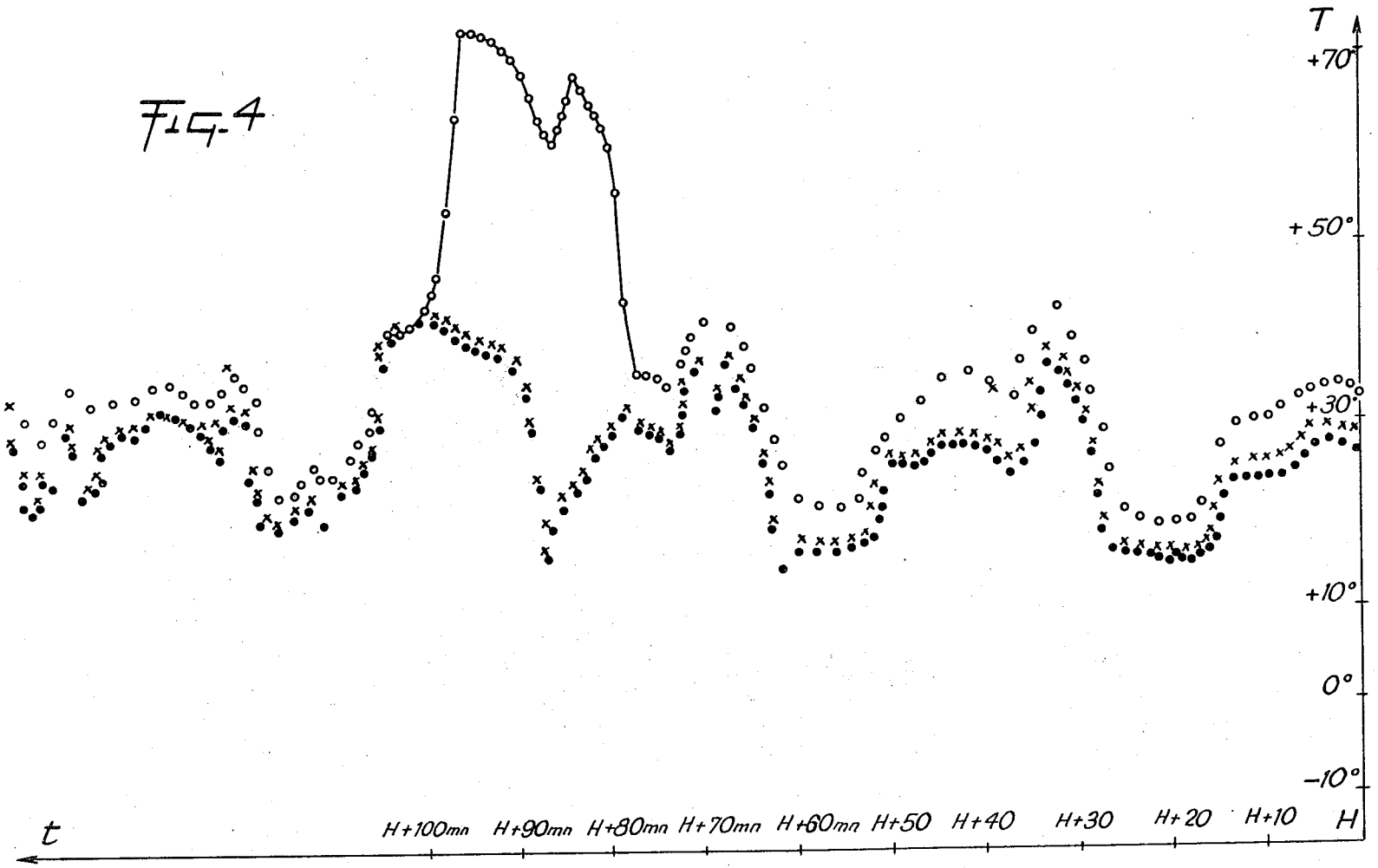
FIG. 4 shows a graphic recording of the measured temperatures of three tuyeres.

An example of graphic recording showing the stoppage of a tuyere is given in FIG. 4. In this figure, which has been drawn from a real experiment, but simplified for clarity's sake, are recorded the temperatures T of three tuyeres in relation to time t.

The temperatures are measured at small intervals of time and shown on the chart by specific reference marks: a dot for the 1st tuyere, an x for the second tuyere, and a circle for the third tuyere. In actual condition, where many more tuyeres are controlled, the different measurements can be recorded by way of colored spots, using a different color for each tuyere. The temperature could also be recorded continuously on this chart.

It is noted from the recordings made in FIG. 4 that between time H (beginning of the graphic recording) and time H+75 mins., the variation of the temperature of the different tuyeres is the same: the three curves follow virtually in parallel the variations linked to the refining process, within a temperature range less than 50°, this representing a normal working of all the tuyeres.

From time H+75 mins., the temperature of the third tuyere (the circles have been joined together by a line to make the phenomenon more visible) increases abnormally with respect to the temperatures of the other tuyeres and reaches 73° at time H+97 mins. when the stoppage is cleared, causing a sudden lowering of the temperature, which temperature then returns at time H+100 mins., to a relatively normal value.

The description has been given principally for tuyeres for blowing in of oxygen in order to simplify the comprehension of the invention. It goes without saying that the invention is also applicable to tuyeres which only include a single tube 4 for the blowing in of a gas such as argon or nitrogen.

What is claimed is:

1. A process for detecting stoppage of gas flow in a tuyere of a metallurgical bottom-blown converter having a refractory lining and a base plate, said tuyere extending through the base plate and the refractory lining, to blow, into and under a molten metallic bath in the converter, a gas compressed at a given pressure and delivered by the tuyere into the molten metallic bath at a pressure lower than said given pressure, said method comprising measuring the temperature of the tuyere at a location below the base plate and detecting abnormal elevation of the temperature of the tuyere indicating a stoppage in the gas flow in the tuyere.

2. A process as claimed in claim 1 wherein said gas is oxygen, nitrogen, argon or mixtures thereof.

3. A process as claimed in claim 1 comprising producing a signal upon said detecting of abnormal elevation of temperature of the tuyere beyond a threshold value.

4. A process as claimed in claim 1 wherein said measuring of the temperature of the tuyere is effected by placing a temperature sensor on said tuyere below the base plate.

5. An apparatus for detection of stoppage of gas flow in a tuyere of a metallurgical bottom-blown converter having a refractory lining and a base plate, said tuyere extending through the base plate and the refractory lining to blow, into and under the molten metallic bath in the converter, a gas compressed at a given pressure and delivered by the tuyere into the metallic bath at a pressure lower than said given pressure, said apparatus comprising:

a temperature measuring sensor on said tuyere at a location proximate to and under the base plate, means coupled to said sensor for detecting abnormal elevation of the temperature of the tuyere, and means for indicating said abnormal elevation of temperature to represent stoppage of gas flow in the tuyere.

6. Apparatus as claimed in claim 5 wherein said means for detecting abnormal elevation of the temperature of the tuyere comprises a visual indicator of the temperature of the tuyere.

7. Apparatus as claimed in claim 5 comprising means for recording the measured temperature of the tuyere.

8. Apparatus as claimed in claim 6 comprising means for recording the measured temperature of the tuyere.

9. Apparatus as claimed in claim 5 wherein said temperature measuring sensor is a thermocouple.

10. Apparatus as claimed in claim 6 wherein said temperature measuring sensor is a thermocouple.

11. Apparatus as claimed in claim 7 comprising means for recording the measured temperature of the tuyere.

* * * * *